US006778801B1

(12) United States Patent
Dougherty

(10) Patent No.: US 6,778,801 B1
(45) Date of Patent: Aug. 17, 2004

(54) IMAGE-FORMING DEVICE AND METHOD WITH ADJUSTABLE TONER CHAMBER CAVITY

(75) Inventor: Patrick S. Dougherty, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/408,208

(22) Filed: Apr. 7, 2003

(51) Int. Cl.[7] ..... G03G 15/08
(52) U.S. Cl. ..... 399/252
(58) Field of Search ..... 399/53, 252, 253, 399/254, 119, 258, 262, 263

(56) References Cited

U.S. PATENT DOCUMENTS

| | | | |
|---|---|---|---|
| 4,371,015 | A | 2/1983 | Simons |
| 4,441,636 | A | 4/1984 | Yamashita et al. |
| 4,855,783 | A | 8/1989 | Takashima et al. |
| 5,053,825 | A | 10/1991 | Trainor et al. |
| 5,055,881 | A | 10/1991 | Fukuchi |
| 5,221,945 | A | 6/1993 | Smith |
| 5,264,900 | A | 11/1993 | Momiyama et al. |
| 5,305,064 | A | 4/1994 | Trott et al. |
| 5,396,316 | A | 3/1995 | Smith |
| 5,435,461 | A | 7/1995 | Smith et al. |
| 5,529,875 | A | 6/1996 | Russell |
| 5,612,770 | A | 3/1997 | Bandai et al. |
| RE35,529 | E | 6/1997 | Michlin |
| 5,774,772 | A | 6/1998 | Kai et al. |
| 5,799,712 | A | 9/1998 | Kelly et al. |
| 5,802,435 | A | 9/1998 | Trask et al. |
| 5,860,048 | A | 1/1999 | Bonanno |
| 5,875,378 | A | 2/1999 | Campbell et al. |
| 5,878,309 | A | 3/1999 | Nomura et al. |
| 5,960,238 | A | 9/1999 | Ohgami |
| 5,963,768 | A | 10/1999 | Rhee |
| 5,991,587 | A | 11/1999 | Kikuchi |
| 6,018,639 | A | 1/2000 | Genovese |
| 6,128,448 | A | 10/2000 | Arcaro et al. |
| 6,144,828 | A | 11/2000 | Sato |
| 6,181,904 | B1 | 1/2001 | Burdette et al. |
| 6,184,909 | B1 | 2/2001 | Matsuno et al. |
| 6,256,469 | B1 | 7/2001 | Taniyama et al. |
| 6,259,877 | B1 | 7/2001 | Taniyama et al. |
| 6,321,048 | B1 | 11/2001 | Michlin |
| 6,347,199 | B1 | 2/2002 | Morihara |
| 6,397,019 | B1 | 5/2002 | Kasuga |
| 6,459,876 | B1 | 10/2002 | Buchanan et al. |

FOREIGN PATENT DOCUMENTS

| | | | |
|---|---|---|---|
| JP | 3-160483 | A * | 7/1991 |
| JP | 3-296078 | A * | 12/1991 |
| JP | 11-174817 | A * | 7/1999 |

OTHER PUBLICATIONS

HP Laser Jet 5N Printer User's Manual, Publication No. C3952–90901, 1996, 9 pages.
HP Laser Jet 4100 Service Manual, Publication No. C8049–90920, 2001, 78 pages.

* cited by examiner

*Primary Examiner*—Sandra L. Brase

(57) ABSTRACT

A method and a device for forming an image upon a medium using toner is provided. The device includes a photosensitive drum, a toner chamber having an interior cavity and at least one toner charge applying member between the drum and the chamber. The at least one charge applying member is configured to apply an electrical charge to toner particles within the cavity. The cavity is adjustable, whereby the cavity is adjusted to improve charging of the toner particles.

65 Claims, 3 Drawing Sheets

IMAGE-FORMING DEVICE AND METHOD WITH ADJUSTABLE TONER CHAMBER CAVITY

BACKGROUND OF THE INVENTION

Current image-forming devices exist in a variety of different configurations. Examples of current image-forming devices include printers and copiers. A detailed discussion of one conventionally known image-forming device is provided in the HP Laser Jet 4100 Service Manual, the first edition of which was published in April 2001 by the Hewlett-Packard Company, the full disclosure of which is hereby incorporated by reference.

Conventional image-forming devices form an image by applying toner to a medium such as paper and fusing the toner onto the paper. One known toner generally comprises a mix of polymers, magnetite, charging agents, flow agents, and pigments or dyes. The toner is typically supplied from a removable cartridge.

Conventional image-forming devices generally create an image upon a medium such as paper by initially creating a uniform negative charge on the surface of a photosensitive drum. A latent image is then formed on the photosensitive drum by modulating laser beams or other light on the photosensitive drum. The latent image on the photosensitive drum is changed to a visual image by the toner that is itself charged and is applied by a developer roller. The visual image created by the toner on the photosensitive drum is transferred to the medium by a transfer charging roller. Thereafter, the transferred toner is fused with heat and pressure to form a permanent image on the medium.

SUMMARY

According to one aspect of the present invention, an image-forming device includes a photosensitive drum, a toner chamber having an interior cavity and at least one toner charge applying member between the drum and the chamber. The at least one charge applying member is configured to apply an electrical charge to toner particles in the cavity. The cavity is adjustable.

According to another aspect of the present invention, a cartridge of use as part of an image-forming device includes a toner chamber having an adjustable interior cavity containing an electrically chargeable toner.

According to another aspect of the present invention, a method for forming an image using toner includes supplying toner from an internal cavity of a chamber to a photosensitive drum, adjusting the cavity and depositing the toner on the photosensitive drum onto a medium.

According to another aspect of the present invention, an image-forming system includes a photosensitive drum, a toner chamber having an interior cavity for containing toner, means for charging toner within the toner chamber and means for adjusting the interior cavity.

DETAILED DESCRIPTION

Figure 1:
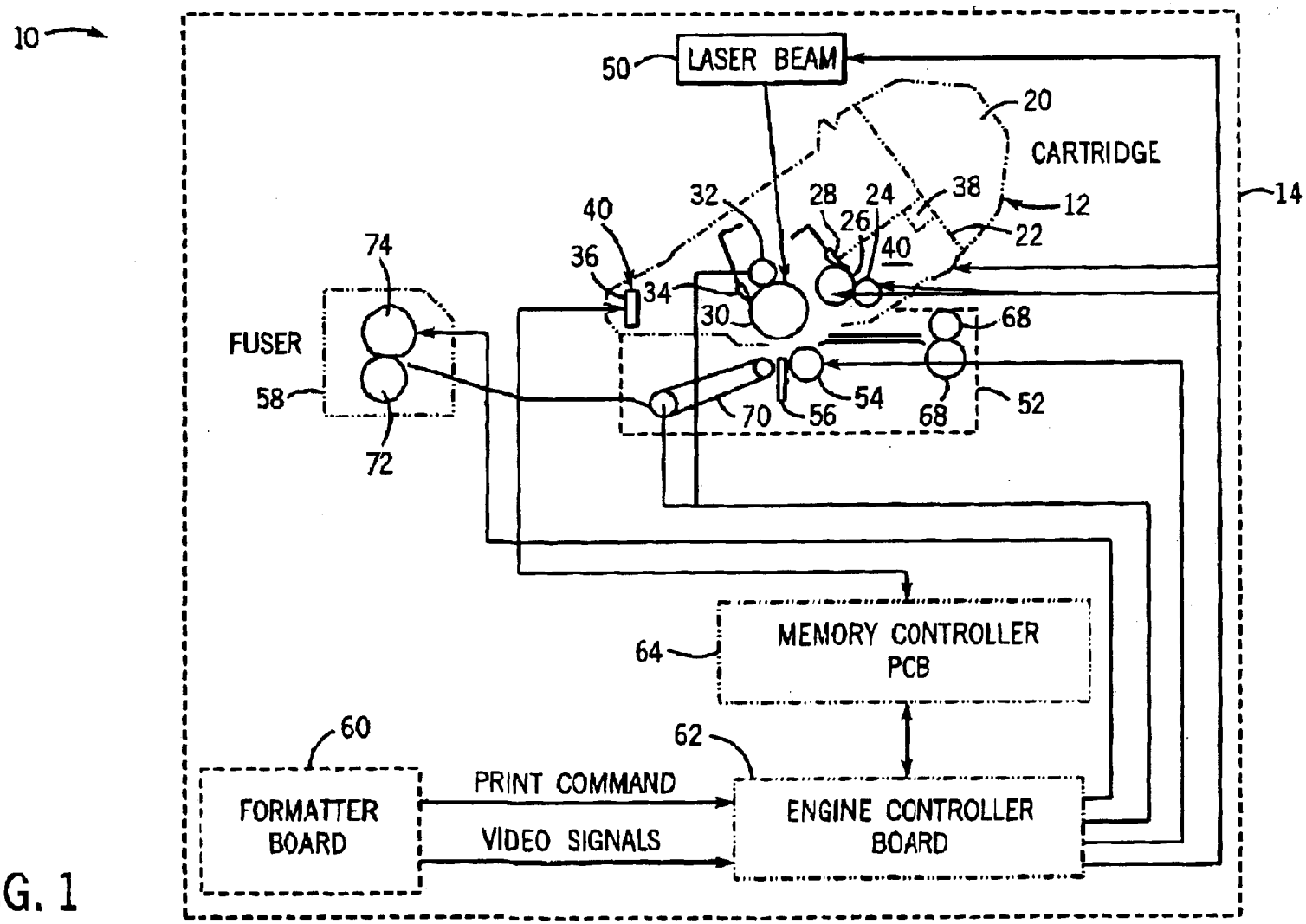
FIG. 1 is a schematic illustration of an image forming device for one example embodiment of the present invention including a main assembly and a cartridge.

FIG. 1 schematically illustrates image forming system or device 10 which generally includes cartridge 12 and main assembly 14. Cartridge 12 is configured to be releasably coupled to main assembly 14 in a conventional manner. Cartridge 12 generally supplies toner for forming images. In the particular embodiment illustrated, cartridge 12 additionally includes components for transferring toner to a print media such as paper. Cartridge 12 generally includes supply hopper 20, toner chamber 22, supply roller 24, developer roller 26, blade 28, photosensitive drum 30, charging roller 32, cleaner blade 34, memory 36 and toner sensor 38.

Supply hopper 20 supplies toner to toner chamber 22. For purposes of this disclosure, the term "toner" means any pigment or dye containing material used for forming an image on a medium, such as polymer, paper and the like. Toner supplied to toner chamber 22 is electrically chargeable. In one embodiment, the toner includes a mix of dye or pigment impregnated plastic, magnitite, various conventionally known electrical charging agents which enhance the ability of the toner to take on an electrical charge and flow agents. In alternative embodiments, the toner utilized by device 10 may comprise other conventionally known or future developed toners that are capable of being electrically charged to a degree sufficient so as to enable the toner to be used by device 10 to form an image upon a print medium. Although cartridge 12 is illustrated as including such components as supply roller 24, developer roller 26, blade 28, photosensitive drum 30, charging roller 32 and cleaner blade 34, these components may be omitted in alternative embodiments. For example, in some applications, main assembly 14 may include photosensitive drum 30 in lieu of photosensitive drum 30 being provided: as part of cartridge 12.

Toner chamber 22 generally includes an internal cavity 40 in which toner is circulated as it is being tribo-electrically charged by one or more toner charge applying members. The ability of the toner within chamber 22 to be charged varies depending upon a number of different factors, such as the exact characteristics of the toner itself, the age of the toner, the extent and duration to which the toner has been stirred or mixed, the circulative flow path of the toner within cavity 40, and the overall volume and/or configuration of cavity 40. To accommodate different charging characteristics of the toner within cavity 40 of chamber 22 and to optimize the image-forming performance of the toner and of system 10, chamber 22 is configured such that cavity 40 is adjustable. As will be described in greater detail hereafter with respect to FIGS. 2–5, the internal configuration of cavity 40 is adjustable such that the toner within cavity 40 flows in different circulative flow paths as guided by the internal configuration of cavity 40. In addition to having an adjustable internal configuration so as to provide a plurality of different circulative flow paths, chamber 22 is also configured to provide an adjustable toner volume for cavity 40. By changing the internal configuration of cavity 40 or by additionally adjusting the toner volume of cavity 40, the charging characteristics of the toner can be varied to optimize the image-forming performance of system 10 and of cartridge 12.

Supply roller 24, developer roller 26 and blade 28 are each conventionally known. Supply roller 24 supplies toner to developer roller 26 which in turn supplies toner to photosensitive drum 30. Blade 28 removes excess toner from developer roller 26. In the particular embodiment illustrated, each of rollers 24 and 26 and blade 28 are electrically charged so as to apply charge to the toner within chamber 22. With such charging, the toner attains a negative charge. The charged particles upon developer roller 26 are then transferred to an electrically charged photosensitive drum 30.

Although rollers 24 and 26 and blade 28 are illustrated and described as being electrically charged so as to apply charge to the toner within chamber 22, less than all of these components, as well as additional or alternative components, may alternatively be used to apply electrical charge to the toner within chamber 22.

Photosensitive drum 30, charging roller 32 and blade 34 are each conventionally known. Charging roller 32 applies a generally uniform negative charge on the surface of drum 30 which is generally rotatably driven in a clockwise direction as seen in FIG. 1. Prior to receiving toner from developer roller 26, light is projected upon the surface of the drum to discharge the negative potential along the surface of the photosensitive drum where the light strikes the surface. As a result, a latent electrostatic image is created on drum 30. As will be described in greater detail hereafter, this light is in the form of a laser.

Once the latent electrostatic image is formed on drum 30, the charged particles from developer roller 26 are transferred to drum 30 in the form of the visible image. This visible image is then transferred to a medium such as paper. Excess or residue toner on the surface of drum 30 is removed by blade 34.

Memory 36 and toner sensor 38 serve as part of a toner charge identification system 40 configured to detect one or more factors relating to charging characteristics of toner within cavity 40. Based on such factors, system 10 adjusts cavity 40 to optimize printing performance. Memory 36 stores data and information regarding cartridge 12. In particular, memory 36 stores such information as the characteristics of the toner in cartridge 12, the age of the toner within cartridge 12, the amount of toner extracted from cartridge 12, the number of copies or amount of medium which have been printed using cartridge 12, and the amount of toner remaining in cartridge 12. Memory 36 may comprise a writeable memory enabling memory 36 to be written upon by main assembly 14. In the particular embodiment illustrated, memory 36 may comprise a conventionally known E-label as are commonly employed on existing printer cartridges except that the E-label is further configured for potentially recording additional information relating to charging characteristics of toner within cartridge 12. An E-label is generally an electronic chip that is manufactured into a cartridge and is located such that the printer or other imaging forming device recognizes the label to identify the particular cartridge and associate information with the cartridge.

Toner sensor 38 is configured to sense one or more factors relating to a charging characteristic of a toner in the cavity. The sensed information is then recorded in memory 36 for use in adjusting cavity 40 or is directly transmitted to the controller of main assembly 14 for adjusting cavity 40. In the particular embodiment illustrated, toner sensor 38 is configured to detect the remaining amount of toner level and the presence of toner in cartridge 12. Furthermore, if sensor 38 senses that the toner has been exhausted, cartridge 12 may be removed from main assembly 14 and discarded or refilled. The removable nature of cartridge 12 further enables cartridge 12 to be easily repaired. In alternative embodiments, toner sensor 38 may be configured to sense other measurable values that correspond to the charging characteristics of the toner within cavity 40. For example, toner sensor 38 may alternatively be configured to sense the amount of media utilized or printed upon by system 10, the number of revolutions of one or more drums in system 10 such as photosensitive drum 30 or the age or time since cartridge 12 was coupled to main assembly 14. In still other embodiments, toner sensor 38 may be omitted, wherein the charging characteristics of the toner within cavity 40 are generally estimated based solely upon the age of cartridge 12 or the elapsed time since cartridge 12 was coupled to main assembly 14. In still other alternative embodiments, memory 36 may be omitted wherein toner charging information is transmitted directly from toner sensor 38 to one or more controllers which generate control signals for adjusting cavity 40.

Main assembly 14 is generally configured to cooperate with cartridge 12 so as to form an image upon a medium such as paper. Main assembly 14 generally includes image writing system 50, media transport 52, transfer charging roller 54, static charge eliminator 56, fuser 58, and a controller generally including formatter board 60, engine controller board 62, and memory controller 64. Image writer 50 is generally configured to apply light or other waves to photosensitive drum 30, such as in the form of a laser, to write a latent electrostatic image upon the surface of drum 30. An example of one conventionally known image writer is disclosed in the HP Laser Jet 4100 Service Manual, First Edition, published in 2001 by Hewlett-Packard Company, the full disclosure of which is hereby incorporated by reference. In alternative embodiments, other conventionally known or future developed image writing systems may be employed.

Media transport 52 is conventionally known and generally comprises that portion of main assembly 14 which is configured to supply and transport a medium, such as paper, upon which an image is to be formed. In the particular embodiment illustrated, media transport 52 includes various rollers 68 and a belt 70 configured to transport media from a paper supply (not shown) between photosensitive drum 30 and transfer charging roller 54 and further to fuser 58. Various other conventionally known or future developed media transfer mechanisms may be employed in lieu of the one schematically shown.

Transfer charging roller 54 and static charge eliminator 56 are each conventionally known. Transfer charging roller 54 facilitates the transfer of toner from drum 30 to the media in a conventionally known manner. Thereafter, static charge upon the media is removed by static charge eliminator 56 in a conventionally known manner. Once the toner has been transferred to the media, media transport 52 transfers the media to fuser 58.

Fuser 58 is configured to fuse the toner to the media to form a permanent image on the media. In the particular embodiment illustrated, fuser 58 fuses the media with heat and pressure. Fuser 58, which is conventionally known, generally includes a pressure roller 72 and a film unit 74. After the image has been permanently fused to the media by fuser 58, the media is expelled by main assembly 14.

The controller including formatter board 60, engine controller board 62 and memory controller 64 generally controls the operation of the remainder of cartridge 12 and main assembly 14. In particular, formatter board 60 sends a print signal and a video signal to the engine controller board 62. In response, the engine controller board 62 drives a main motor (not shown) to rotate photosensitive drum 30, charging roller 32, supply roller 24, developing roller 26, various belts and rollers of media transport 52, transfer charging roller and the pressure roller, amongst others. In response to signals from the engine controller board based upon the video signals, image writing system 50 modulates laser beams to create a latent image on the photosensitive drum.

Memory controller 64 generally comprises a control circuit configured to write data to memory 36 and read data from memory 36 of cartridge 12. Memory controller 64 records such data on memory 36 such as the number of copies or amount of media printed upon using toner from cartridge 12, job length, media size, mode, coverage, fuser and other historical data regarding the image formation using cartridge 12. Controller 64 further reads such recorded information from memory 36 and based on such information, cooperates with engine controller board 62 to generate control signals. In the particular embodiment, such control signals are used to optimize the image-forming performance of system 10 in part by optimizing the charging capability of toner within cavity 40. In particular, memory controller 64 in cooperation with engine controller board 62 generate control signals to optimally adjust cavity 40 based upon one or more detected factors relating to the charging characteristic of the toner, such as the amount of toner previously removed from chamber 22, the age of the toner within chamber 22 and the like.

Figure 2:
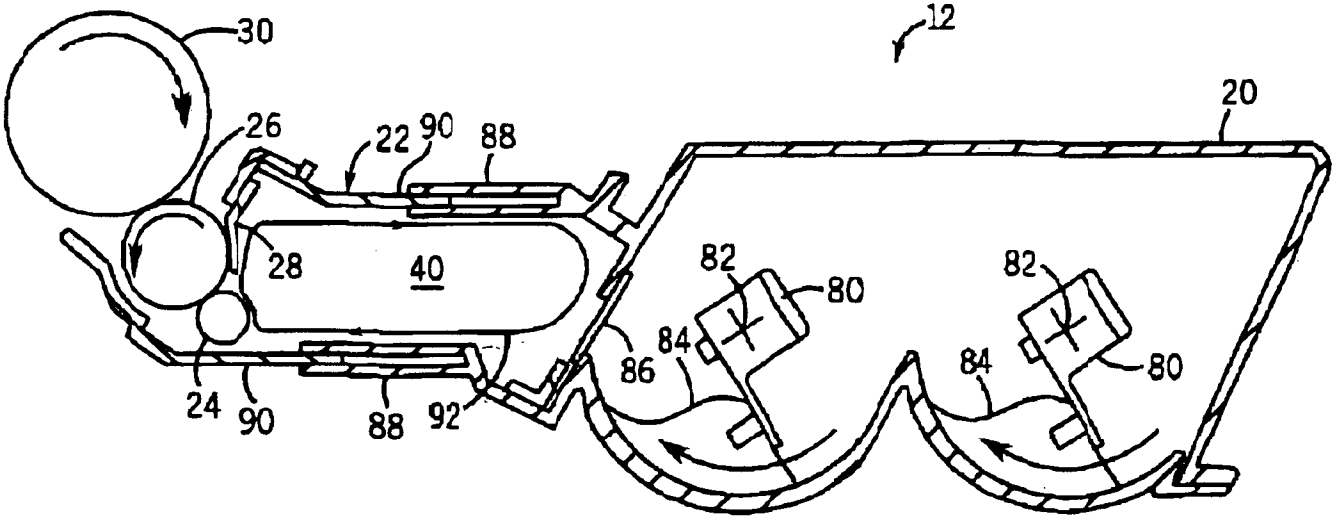
FIG. 2 is a sectional view schematically illustrating internal components of the cartridge of FIG. 1 having a toner cavity in a first state.
Figure 3:
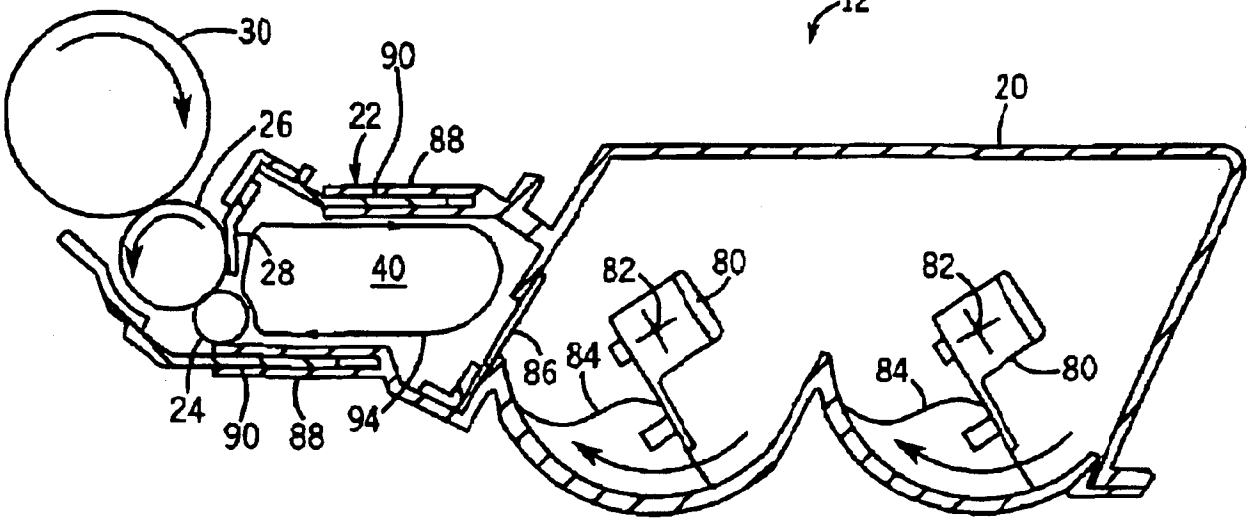
FIG. 3 illustrates the cartridge of FIG. 2 with the toner cavity in a second adjusted state.

FIGS. 2 and 3 are sectional views schematically illustrating portions of cartridge 12 in greater detail. For ease of illustration, the exterior enclosure or housing of cartridge 12 is not shown. The exact configuration of the exterior housing or enclosure of cartridge 12 may vary depending upon the size and configuration of the various internal components of cartridge 12 as well as the interfacing relationship between cartridge 12 and the main assembly 14.

FIG. 2 illustrates toner cavity 40 in a first state, while FIG. 3 illustrates toner cavity 40 adjusted to a second state. In FIG. 2, toner cavity 40 has a first internal configuration and has a first toner volume. In FIG. 3, toner cavity 40 has been adjusted so as to have a second distinct internal configuration, as well as a second smaller toner volume. The toner volume is generally the volume in which toner may occupy within cavity 40. Such adjustment is generally made taking into account the various detected factors relating to the charging characteristics of the toner so as to improve the charging characteristics of the toner within cavity 40.

As shown by FIGS. 2 and 3, supply hopper 20 includes a plurality of mixing devices (shown as paddles 80) which pivot about axes 82 to mix toner 84 within the interior volume of hopper 20. At the same time, toner 84 is moved toward a valve 86 located between hopper 20 and chamber 22. Valve 86 is generally a one-way valve configured to regulate the flow of toner 84 into cavity 40.

As shown by FIGS. 2 and 3, to facilitate the adjustment of cavity 40, chamber 22 includes wall portions 88 and 90 which are movable relative to one another. In the particular embodiment illustrated, wall portions 88 and 90 are slidable relative to one another. In particular, wall portion 90 is telescopically received within wall portion 88 in a fashion so as to maintain a generally sealed interior about cavity 40 while permitting the configuration and volume of cavity 40 to be adjusted. Movement of wall portion 90 relative to wall portion 88 changes the circulative flow path of the toner within cavity 40 as indicated by arrows 92 and 94. As shown by FIGS. 2 and 3, the volume of cavity 40 is also changed as a result of movement of wall portions 88 and 90 relative to one another.

Although wall portions 88 and 90 are illustrated as sliding relative to one another, wall portions 88 and 90 may alternatively move relative to one another in other fashions, such as folding relative to one another or rotating or pivoting relative to one another. Movement of wall portions 88 and 90 may be performed by utilizing one or more actuators to move one or both of wall portions 88 and 90 relative to one another. In one particular embodiment, a linear actuator such as an electric solenoid, pneumatic cylinder assembly or the like is utilized to move wall portion 88 relative to wall portion 90. In another embodiment, one or more cams rotatably driven by the existing motor of system 10 (not shown) may be operably coupled to wall portion 88 to move wall portion 88 relative to wall portion 90.

Figure 4:
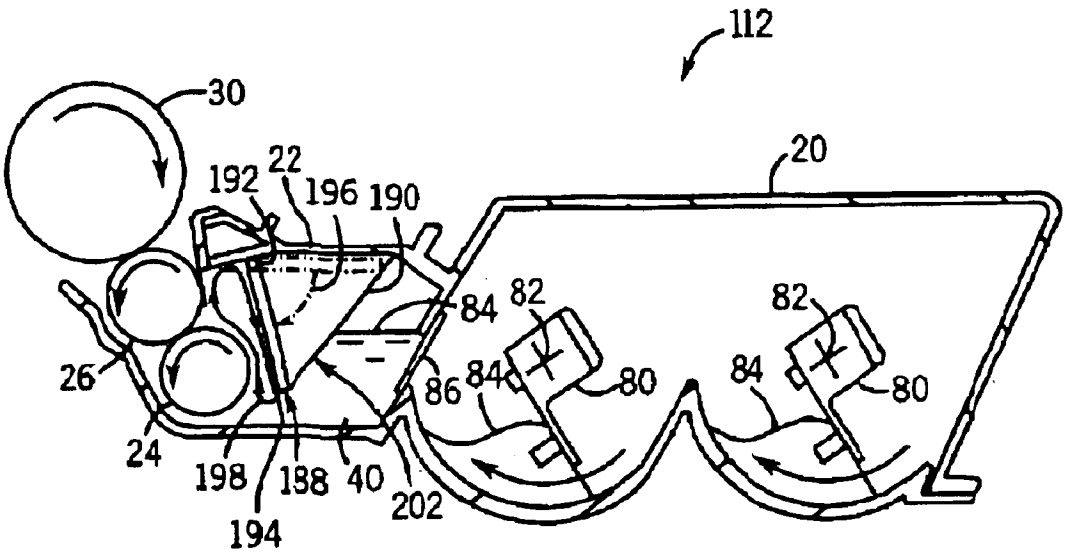
FIG. 4 is a sectional view schematically illustrating an alternative embodiment of the cartridge of FIG. 2 having a toner cavity in a first state.
Figure 5:
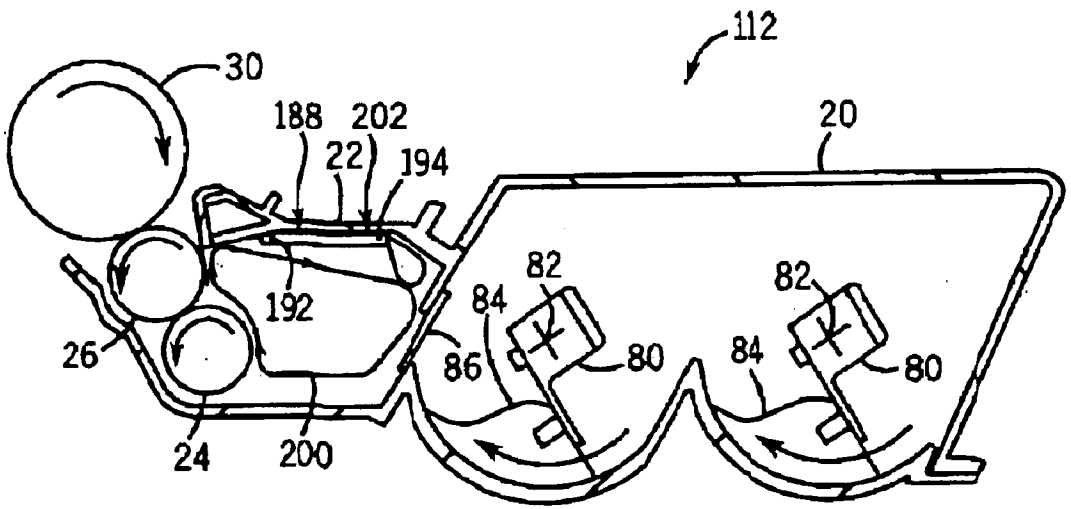
FIG. 5 illustrates the cartridge of FIG. 4 with the toner cavity in a second adjusted state.

FIGS. 4 and 5 illustrate cartridge 112, an alternative embodiment of cartridge 12 shown in FIGS. 2 and 3. Like cartridge 12, cartridge 112 is removably mounted as part of system 10. Cartridge 112 is substantially identically to cartridge 12, except that toner chamber 22 replaces movable wall portions 88 and 90 with generally fixed wall portions and that toner chamber 22 additionally includes configuration adjustment member 188 and membrane 190. For ease of illustration, those remaining components of cartridge 112 which are substantially identical to corresponding components of cartridge 12 are numbered similarly. Configuration adjustment member 188 generally comprises a panel having a first portion 192 pivotally coupled to toner chamber 22 and a second opposite portion 194 which projects into toner cavity 40. As shown by FIG. 4, adjustment member 188 pivots about portion 192 between a retracted position (shown in phantom lines) and an extended position (shown in solid lines) in the direction indicated by arrow 196. Depending upon whether adjustment member 188 is in the extended position, the fully retracted position or one of a plurality of intermediate positions therebetween, adjustment member 188 guides toner 84 in different circulative (i.e., generally continuous and unending) flow paths within cavity 40 as indicated by the circulative flow paths identified by reference numbers 198 and 200 in FIGS. 4 and 5, respectively.

Membrane 190 is a generally elongate flexible membrane capable of being folded or at least partially collapsed. Membrane 190 is generally coupled to portion 194 and is also coupled to chamber 22. Membrane 190 in cooperation with adjustment member 188 and in conjunction with member 188 forms a volume adjustment member 202 that occupies varying percentages of toner cavity 40 to adjust the volume of cavity 40 that may receive or hold toner 84. In particular, as shown in FIG. 5, when adjustment member 188 is in the retracted position which causes membrane 190 to fold upon itself, toner cavity 40 is adjusted in two fashions: (1) the overall configuration of cavity 40 is different and (2) the volume of cavity 40 for containing toner is substantially larger. As shown in FIG. 4, when adjustment member 188 is pivoted to the fully extended position, membrane 90 is also extended so as to occupy a larger percentage of the toner volume of cavity 40. Depending upon the charging characteristics of toner 84 within cavity 40, the configuration and/or volume of cavity 40 may be adjusted for optimal charging characteristics.

Adjustment member 188 may be pivoted between the fully retracted position and the fully extended position by the existing motor (not shown) provided as part of main assembly 14 of system 10 through a conventionally known or future developed power train consisting of belts, pulleys, gears or the like. In alternative embodiments, member 188 may be pivoted by alternative rotary actuators or by appropriately configured linear actuators.

In lieu of being pivoted between the two positions, member 188 may alternatively be moved in other fashions such as by sliding movement. For example, member 188 may generally be in the form of a baffle which slidably passes through a corresponding sealed opening in one of the walls of chamber 22 between a fully extended position and a fully retracted position. Although adjustment member 188 may be imperforate, in alternative embodiments where membrane 190 is omitted, configuration adjustment member 188 may be perforate or may include variously configured vanes or other structures chosen so as to optimally redirect the circulative flow of toner 84 within cavity 40.

Although membrane 190 is illustrated as a flexible membrane that is employed in conjunction with member 188, membrane 190 may be used independently of member 188. For example, other means may be employed to move membrane 190 between an expanded state and a retracted or collapsed state. For example, membrane 190 may alternatively be selectively inflated and deflated to occupy differing percentages of the volume of cavity 40. Furthermore, in alternative embodiments, membrane 190 may be replaced with a generally inflexible panel or other structure having one end coupled to member 188, wherein the other end of the inflexible structure slidably passes through a sealed slot formed in toner chamber 22. In still other embodiments, membrane may be replaced with a generally inflexible panel or other structure having fold or hinge lines which permit the structure to fold upon itself and collapse to adjust the volume of cavity 40.

Overall, system 10 employing cartridge 12 or 112 provides a printing system that optimally adjusts the circulative flow path of the toner within the toner chamber by either adjusting the internal configuration of the chamber adjacent the cavity or by adjusting the volume of the toner chamber cavity. Such adjustment is made based upon one or more factors affecting the charging characteristics of the toner within the cavity as recorded in cartridge memory 36. Examples of such factors include the amount of toner remaining within the cartridge, age of the toner within the cartridge, the number of copies or amount of medium printed upon using the cartridge, the frequency and extent of mixing or stirring of the toner within the cartridge and the particular characteristics of the toner itself. By adjusting the cavity of the toner chamber, charging of the toner can be optimized over the life of a cartridge to improve image-forming performance.

Although system 10 is illustrated as main system 14 into which a removable cartridge 12 or 112 is positioned, system 10 may alternatively comprise a single assembly wherein both components of cartridge 12 or 112 are permanently integrated into the assembly. In such an alternative embodiment, means may be provided for refilling the toner chamber and/or the supply hopper (if provided) with toner. Although information or data regarding factors affecting the charging characteristics of the toner are described, according to one embodiment, as being recorded or contained in cartridge memory 36, such information may alternatively be recorded in the memory associated with main assembly 14 or in memory associated with peripheral devices, such as a computer coupled to system 10. In some applications, the cartridge may simply be provided with memory or other means for enabling system 10 to identify the cartridge, the type of toner contained within the cartridge and the initial volume of toner contained within the cartridge and/or the initial volume of toner contained within the cartridge. Although the adjustable toner chamber 22 is illustrated for use in conjunction with system 10, adjustable toner chamber 22 may alternatively be utilized with other conventionally known or future developed image-forming systems including printers, copiers and the like.

Although the present invention has been described with reference to certain embodiments, workers skilled in the art will recognize that changes may be made in form and detail without departing from the spirit and scope of the invention. For example, although different embodiments may have been described as including one or more features providing one or more benefits, it is contemplated that the described features may be interchanged with one another or alternatively be combined with one another in the described embodiments or in other alternative embodiments. Because the technology of the present invention is relatively complex, not all changes in the technology are foreseeable. The present invention described with reference to the foregoing embodiments and set forth in the following claims is manifestly intended to be as broad as possible. For example, unless specifically otherwise noted, the claims reciting a single particular element also encompass a plurality of such particular elements.

What is claimed is:

1. An image-forming device comprising:

a photosensitive drum;

a toner chamber having an interior cavity; and at least one toner charge applying member between the drum and the chamber, wherein the at least one charge applying member is configured to apply an electrical charge to toner particles within the cavity and wherein the cavity is adjustable.

2. The device of claim 1, wherein the cavity has a toner volume configured to contain toner and wherein the toner volume is adjustable.

3. The device of claim 2 including a volume adjustment member configured to move between a first state in which the member occupies a first volume in the cavity and a second state in which the member occupies a second larger volume in the cavity to vary a toner containing volume of the cavity.

4. The device of claim 3, wherein the volume adjustment member pivots between the first state and the second state.

5. The device of claim 3, wherein the volume adjustment member includes:

a panel having a first portion pivotally. coupled to the chamber and a second portion; and a flexible membrane coupled to the second portion of the panel and the chamber.

6. The device of claim 2, wherein the chamber includes a first wall portion and a second wall portion and wherein the first wall portion is movable relative to the second wall portion to vary a toner containing volume of the cavity.

7. The device of claim 6, wherein the first wall portion is telescopically received within the second wall portion.

8. The device of claim 6, wherein the first wall portion slides relative to first wall portion.

9. The device of claim 1 including a configuration adjustment member movably coupled to the chamber, wherein the configuration adjustment member moves between a first position in which the configuration adjustment member is adapted to guide toner in a first circulative flow path within the cavity and a second position in which the configuration adjustment member is configured to guide toner in a second different circulative flow path in the cavity.

10. The device of claim 9, wherein the configuration adjustment member pivots between the first position and the second position.

11. The device of claim 1 including a supply hopper configured to supply toner to the cavity.

12. The device of claim 11 including a valve between the supply hopper and the cavity.

13. The device of claim 1, wherein the at least one toner charge-applying member includes a developer roller.

14. The device of claim 13, wherein the at least one toner charge-applying member includes a blade adjacent the developer roller.

15. The device of claim 14, wherein the at least one toner charge-applying member includes a supply roller.

16. The device of claim 1 including a toner charge identification system configured to detect a factor related to a charging characteristic of the toner in the cavity, wherein the system adjusts the cavity based at least upon the detected factor.

17. The device of claim 16, wherein the toner charge identification system includes a use indicator configured to determine removal of toner from the chamber.

18. The device of claim 16, wherein the toner identification system includes recordable memory upon which information related to charging characteristics of the toner is stored.

19. The device of claim 1 including:

a medium transport configured to supply a medium to the photosensitive drum; and a fuser configured to fuse at least portions of the toner upon the medium.

20. The device of claim 19 including a cartridge removably coupled to the medium-transport, wherein the cartridge contains the photosensitive drum, the at least one toner charge-applying member and the chamber.

21. The device of claim 20, wherein the cartridge includes a write memory configured to store information related to at least one charging characteristic of toner within the cavity.

22. A cartridge for use as part of an image-forming device, the cartridge comprising:

a toner chamber having an adjustable, interior cavity containing electrically chargeable toner particles; and at least one toner charge-applying member configured to apply an electrical charge to the toner particles within the cavity.

23. The cartridge of claim 22, wherein the cavity has a toner volume configured to contain toner and wherein the toner volume is adjustable.

24. The cartridge of claim 23 including a volume adjustment member configured to move between a first state in which the member occupies a first volume in the cavity and a second state in which the member occupies a second larger volume in the cavity to vary the toner volume of the cavity.

25. The cartridge of claim 24, wherein the volume adjustment member pivots between the first state and the second state.

26. The cartridge of claim 25, wherein the volume adjustment member includes:

a panel having a first portion pivotally coupled to the chamber and a second portion; and a flexible membrane coupled to the second portion of the panel and the chamber.

27. The cartridge device of claim 23, wherein the chamber includes a first wall portion and a second wall portion and wherein the first wall portion is movable relative to the second wall portion to vary the toner volume.

28. The cartridge of claim 27, wherein the first wall portion is telescopically received within the second wall portion.

29. The cartridge of claim 27, wherein the first wall portion slides relative to the second wall portion.

30. The cartridge of claim 22 including a configuration adjustment member movably coupled to the chamber, wherein the configuration adjustment member moves between a first position in which the configuration adjustment member is adapted to guide toner in a first circulative flow path within the cavity and a second position in which the configuration adjustment member is configured to guide toner in a second different circulative flow path in the cavity.

31. The cartridge of claim 30, wherein the configuration adjustment member pivots between the first position and the second position.

32. The cartridge of claim 22 including a supply hopper configured to supply toner to the cavity.

33. The cartridge of claim 32 including a valve between the supply hopper and the cavity.

34. The cartridge of claim 22, wherein the at least one toner charge-applying member includes a developer roller.

35. The cartridge of claim 34, wherein the at least one toner charge-applying member includes a blade adjacent the developer roller.

36. The cartridge of claim 35, wherein the at least one toner charge-applying member includes a supply roller.

37. The cartridge of claim 22 including a photosensitive drum.

38. The cartridge of claim 22 including a toner charge identification system configured to detect a factor related to a charging characteristic of the toner in the cavity, wherein the system adjusts the cavity based at least upon the detected factor.

39. The cartridge of claim 38, wherein the toner charge identification system includes a use indicator configured to determine removal of toner from the chamber.

40. The cartridge of claim 38, wherein the toner identification system includes recordable memory upon which information related to charging characteristics of the toner is stored.

41. A method for forming an image using toner, the method comprising:

supplying toner from an internal cavity of a chamber to a photosensitive drum;

adjusting the cavity by adjusting a size of the chamber; and depositing the toner on the photosensitive drum onto a medium.

42. The device of claim 41, wherein adjusting the cavity comprises adjusting a toner containing volume of the cavity.

43. The method of claim 42, wherein adjusting the toner-containing volume of the cavity includes occupying varying percentages of the cavity to adjust the toner-containing volume of the cavity.

44. The method of claim 41, wherein adjusting the cavity includes adjusting a configuration of the cavity.

45. The method of claim 41 including:

detecting a factor related to a charging characteristic of toner in the cavity, wherein the cavity is adjusted based upon the detected factor.

46. The method of claim 45, wherein detecting a factor includes identifying an amount of toner previously removed from the chamber.

47. The method of claim 45, wherein detecting a factor includes identifying an age of toner within the chamber.

48. The method of claim 45, wherein detecting a factor includes determining an amount of medium onto which the toner has been deposited.

49. An image-forming system comprising:

a photosensitive drum;

a toner chamber having an interior cavity for containing toner;

means for applying charge to toner within the toner chamber; and means for adjusting the interior cavity.

50. A system of claim 49, wherein the means for adjusting a toner containing volume of the cavity includes means for adjusting a toner containing volume of the cavity.

51. The system of claim 50, wherein the means for adjusting the toner containing volume of the cavity includes means for adjusting a size of the chamber.

52. The system of claim 50, wherein the means for adjusting the toner containing volume of the cavity includes means for occupying varying percentages of the cavity to adjust the toner-containing volume of the cavity.

53. The system of claim 52, wherein the means for detecting a factor includes means for identifying an age of the toner within the chamber.

54. The system of claim 52, wherein the means for detecting a factor includes means for determining an amount of medium onto which the toner has been deposited.

55. The system of claim 49, wherein the means for adjusting the interior cavity includes means for adjusting a configuration of the cavity.

56. The system of claim 49, including:

a means for detecting a factor related to a charging characteristic of toner in the cavity; and a means for adjusting the cavity based upon the factor.

57. The system of claim 56, wherein the means for detecting a factor includes means for identifying an amount of the toner previously removed from the chamber.

58. A cartridge for use as part of an image-forming device, the cartridge comprising:

a toner chamber having an adjustable, interior cavity containing electrically chargeable toner particles, wherein the toner volume is adjustable; and a volume adjustment member configured to pivot between a first state in which the member occupies a first volume in the cavity and a second state in which the member occupies a second larger volume in the cavity to vary the toner volume of the cavity, wherein the volume adjustment member includes:

a panel having a first portion pivotally coupled to the chamber and a second portion; and a flexible membrane coupled to the second portion of the panel and the chamber.

59. A cartridge for use as part of an image-forming device, the cartridge comprising:

a toner chamber having an adjustable, interior cavity containing electrically chargeable toner particles, wherein the cavity has a toner volume configured to contain toner, wherein the toner volume is adjustable, and wherein the chamber includes a first wall portion and a second wall portion and wherein the first wall portion is movable relative to the second wall portion to vary the toner volume.

60. The cartridge of claim 59, wherein the first wall portion is telescopically received within the second wall portion.

61. A cartridge for use as part of an image-forming device, the cartridge comprising:

a toner chamber having an adjustable, interior cavity containing electrically chargeable toner particles; and a toner charge identification system configured to detect a factor related to a charging characteristic of the toner in the cavity, wherein the system adjusts the cavity based at least upon the detected factor and wherein the toner charge identification system includes a use indicator configured to determine removal of toner from the chamber.

62. A cartridge for use as part of an image-forming device, the cartridge comprising:

a toner chamber having an adjustable, interior cavity containing electrically chargeable toner particles; and a toner charge identification system configured to detect a factor related to a charging characteristic of the toner in the cavity, wherein the system adjusts the cavity based at least upon the detected factor and wherein the toner identification system includes recordable memory upon which information related to charging characteristics of the toner is stored.

63. A method for forming an image using toner, the method comprising:

supplying toner from an internal cavity of a chamber to a photosensitive drum;

adjusting the cavity;

depositing the toner on the photosensitive drum onto a medium; and detecting a factor related to a charging characteristic of toner in the cavity, wherein the cavity is adjusted based upon the detected factor and wherein detecting a factor includes identifying an amount of toner previously removed from the chamber.

64. A method for forming an image using toner, the method comprising:

supplying toner from an internal cavity of a chamber to a photosensitive drum;

adjusting the cavity;

depositing the toner on the photosensitive drum onto a medium; and detecting a factor related to a charging characteristic of toner in the cavity, wherein the cavity is adjusted based upon the detected factor and wherein detecting a factor includes identifying an age of toner within the chamber.

65. A method for forming an image using toner, the method comprising:

supplying toner from an internal cavity of a chamber to a photosensitive drum;

adjusting the cavity;

depositing the toner on the photosensitive drum onto a medium; and detecting a factor related to a charging characteristic of toner in the cavity, wherein the cavity is adjusted based upon the detected factor and wherein detecting a factor includes determining an amount of medium onto which the toner has been deposited.

* * * * *